US007107123B2

(12) United States Patent
Watanabe et al.

(10) Patent No.: US 7,107,123 B2
(45) Date of Patent: Sep. 12, 2006

(54) FOOD DISHING ROBOT SYSTEM

(75) Inventors: Atsushi Watanabe, Tokyo (JP); Kazuhisa Otsuka, Yamanashi (JP); Hiroaki Kubota, Fujiyoshida (JP); Tadamasa Horiuchi, Yamanashi (JP)

(73) Assignee: Fanuc LTD, Yamanashi (JP)

( * ) Notice: Subject to any disclaimer, the term of this patent is extended or adjusted under 35 U.S.C. 154(b) by 905 days.

(21) Appl. No.: 10/278,864

(22) Filed: Oct. 24, 2002

(65) Prior Publication Data

US 2003/0075051 A1 Apr. 24, 2003

(30) Foreign Application Priority Data

Oct. 24, 2001 (JP) ..... 2001/325966

(51) Int. Cl.
*G06F 19/00* (2006.01)

(52) U.S. Cl. ..... 700/245; 99/325; 99/468; 244/325; 244/468; 141/1; 141/29; 141/168

(58) Field of Classification Search ..... 700/245; 99/325, 468; 244/118.1; 141/1, 29, 168
See application file for complete search history.

(56) References Cited

U.S. PATENT DOCUMENTS 5,353,847 A * 10/1994 Cahlander et al. ..... 141/1
5,534,679 A * 7/1996 Beaver et al. ..... 219/413
6,869,633 B1 * 3/2005 Sus et al. ..... 426/438
6,871,676 B1 * 3/2005 Sus et al. ..... 141/83

FOREIGN PATENT DOCUMENTS

JP 06135548 5/1994
JP 6-135548 8/1994
JP 09065838 3/1997
JP 9-65838 7/1997
JP 11124102 5/1999
JP 11-124102 8/1999

OTHER PUBLICATIONS

Li et al. Applying vision guidance in robotic food handling, IEEE, 1996, pp. 4-12.*

* cited by examiner

*Primary Examiner*—Thomas G. Black
*Assistant Examiner*—McDieunel Marc
(74) *Attorney, Agent, or Firm*—Staas & Halsey LLP

(57) ABSTRACT

A food dishing robot system capable of dealing with dishing operations of foods of various characteristics. Trays are supplied to vicinities of food dishing robots RB1–RB3 by food supplying lines L1–L3. Four food conveying containers are placed on each tray. Each of the robots RB1–RB3 handles a food conveying container containing a food on the tray to move the food conveying container over a lunch box supplied by a lunch box supplying line L4 at a predetermined position, and dishes the food on a predetermined space in the lunch box. The food contained in the food conveying container is discharged through a cutout or an opening formed at a side thereof by inclining the food conveying container. The food conveying container may have a bottom plate to be opened/closed or the robot may have an auxiliary member in the form of scoop to forcedly discharge the food from the food conveying container. After completing the dishing of the food, the food conveying container is returned on the tray. Shaped, shapeless, solid, powdery, granular and liquid food can be dished on the lunch box.

12 Claims, 10 Drawing Sheets

FOOD DISHING ROBOT SYSTEM

BACKGROUND OF THE INVENTION

1. Field of the Invention

The present invention relates to a robot system for dishing food contained in a food conveying container on a food dishing container, e.g. a lunch box and a dish, by handling the food conveying container using a robot. The present invention is applicable to dishing operations of liquid or fluid food as well as processed food and rice. The "food" as referred to in the specification includes various condiments such as sugar, salt, source and soy source.

2. Description of Related Art

Handling of food by a robot is adopted in packing a processed food such as a frozen food into a box in a food processing factory. However, dishing of a cooked food processed by heat on a dishing container, such as a lunch box, a dish and a plate, has been carried out manually and it is scarce to use a robot for dishing such food.

In the case of using a robot for dishing food on a dishing container, it is carried out by holding a shaped food and it is regarded to be difficult to dish the liquid or fluid food and thus scarcely carried out. There is not known a robot system for dishing food comprising a plurality of pieces of food such as boiled vegetables or shapeless food such as julienne of cabbage on the dishing container such as lunch box and a dish by a robot.

A cause of failing to provide a robot system for dishing food other than shaped food on the food dishing container is considered that the food which can be held by a hand of a robot is restricted to the solid food. There arise problems that a structure of the robot hand is made complicated for handling a food other than the shaped food such as a frozen food and special hands dedicated for respective kinds of food are required, to increase a cost of the robot system.

Further, in the conventional method of directly hold the food, it is difficult to cope with new menu rapidly. Specifically, the food heated or thawed is soft and tends to be deformed and therefore there is a case where the food is deformed by direct holing by a robot hand to lose value as a commodity. Further, it is difficult to securely carry the deformed food to a predetermined position for conveyance.

This is not a rare case. For example, the foods to be dished on a lunch box are shapeless and of variety of kinds, such as rice, cut cabbage, boiled vegetable and pasta, etc. It has been desired a robot system for securely dishing the various foods on the food dishing containers.

SUMMARY OF THE INVENTION

An object of the present invention is to provide a robot system capable of securely performing dishing operations of various foods.

The present invention provides a robot system capable of dishing a food contained in a food conveying container on a food dishing container such as a lunch box and a dish by handling the food conveying container by a food dishing robot.

The food dishing robot system of the present invention comprises: a robot having a hand for handling a food conveying container; and a controller for controlling the robot to hold the food conveying container containing a food by the hand, to carry the food conveying container held by the hand over a food dishing container, and to dish the food contained in the food conveying container on the food dishing container.

The handling of the food conveying container by the hand can be performed by holding or suction. It is preferable that the hand holds a periphery of the food conveying container to be carried. The hand can simultaneously holds a plurality of food conveying containers to be carried.

The food dishing robot system may further comprise food supply means for supplying the food conveying container containing the food to the robot, and food dishing container supply means for supplying the food dishing container to the robot.

The food conveying container may have a cutout on a side thereof. In this case, the controller controls the robot to incline the food conveying container held by the hand such that the food contained in the food conveying container is discharged therefrom through the cutout.

The hand may have an auxiliary member in the form of scoop. In this case, the controller controls the robot such that the food contained in the food conveying container is discharged through said cutout out of the food conveying container by means of the auxiliary member.

The food conveying container may have a spout on a side thereof. In this case, the controller controls the robot to incline the food conveying container held by the hand such that the food contained in the food conveying container is discharged therefrom through the spout.

The food conveying container may have an opening/closing bottom portion. In this case, the controller controls the robot to open the opening/closing bottom portion such that the food contained in the food conveying container is discharged therefrom.

The food supply means may have a tray on which at least one food conveying container is placed and the food conveying container placed on the tray is supplied to the robot.

The food dishing container may have a plurality of divided spaces. In this case, the controller designates a space of said plurality of divided spaces to which the food contained in the food conveying container held by the hand is to be dished and controls the robot to dish the food to the designated space in the food dishing container.

The controller may includes means for providing positional information on the food dishing container, and may control the robot to dish the food to the designated space in the food dishing container based on the provided positional information.

It is preferable that the tray and the food conveying container are made of heat-resistant material such as stainless steel.

BRIEF DESCRIPTION OF THE DRAWINGS

FIGS. 7*a*–7*c* are schematic views showing discharging of the food from the food conveying container using an auxiliary member, in which FIG. 7*a* shows a state before holding the food conveying container, FIG. 7*b* shows a state in which the robot hand holds the food conveying container before actuating the auxiliary member, and FIG. 7*c* shows a state in which the robot hand holds the food conveying container and the auxiliary member is actuated;

FIGS. 8*a* and 8*b* are schematic perspective views of a tray having divided areas on which the food conveying containers are placed, in which FIG. 8*a* shows a state before the food conveying containers are placed and FIG. 8*b* shows a state in which a food conveying container is placed at an area AR1;

FIG. 9*a* and 9*b* are schematic perspective views of food dishing containers having divided spaces on which the foods are dished, in which FIG. 9*a* shows divided spaces in a round food dishing container and FIG. 9*b* shows divided spaces in a rectangular food dishing container;

DETAILED DESCRIPTION OF THE PREFERRED EMBODIMENTS

Figure 1:
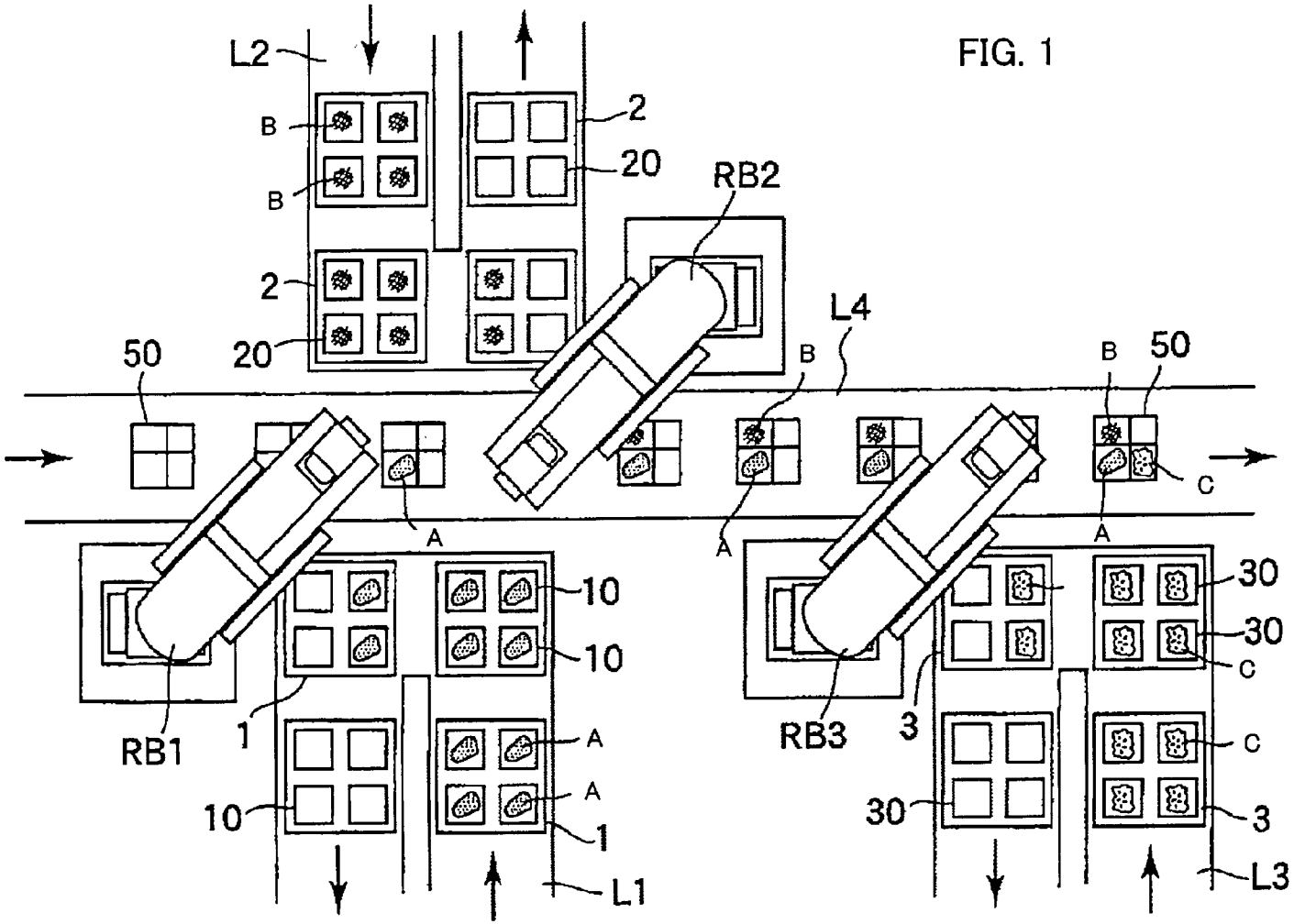
FIG. 1 is a schematic view of a food dishing robot system according to an embodiment of the present invention.
Figure 2:
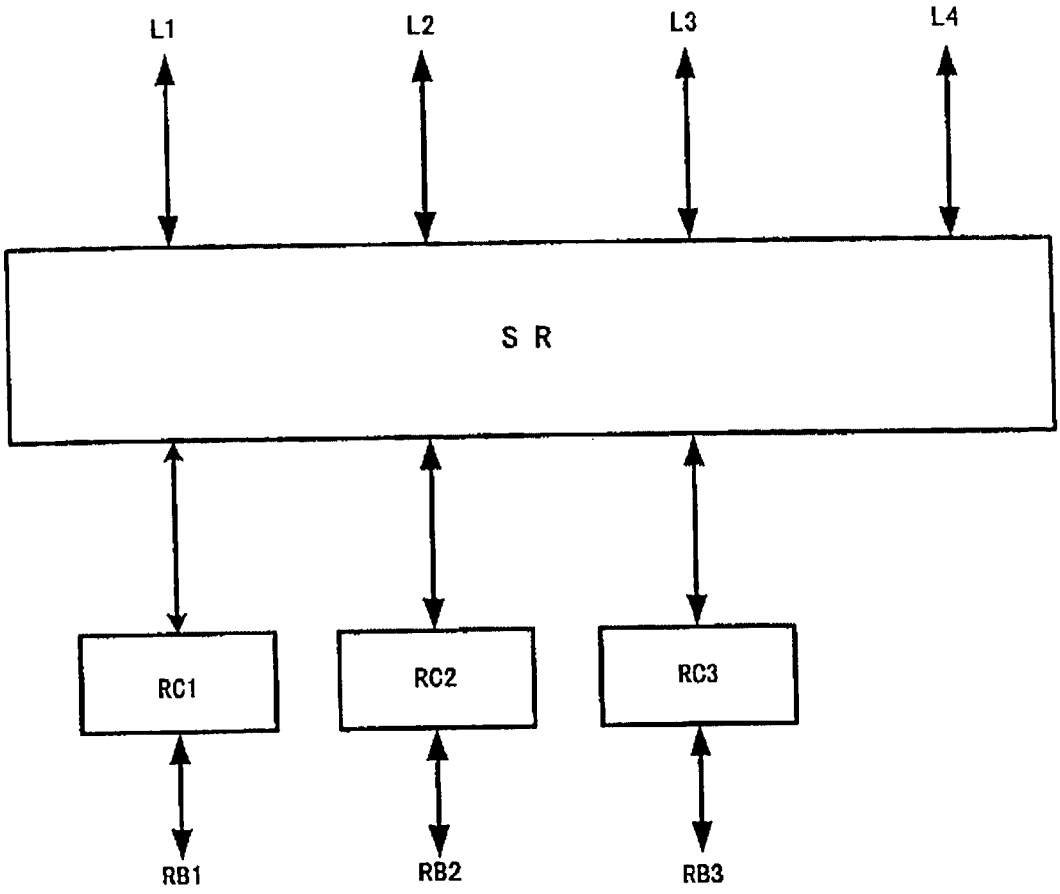
FIG. 2 is a block diagram showing connection among food dishing robots, food supplying lines, a food dishing container supply line and controllers therefor in the food dishing robot system shown in FIG. 1.

FIGS. 1 and 2 show a food dishing robot system according to an embodiment of the present invention. In FIG. 1, three food dishing robots RB1 to RB3 and four supply lines L1–L4 are shown. As shown in FIG. 2, the robots RB1 to RB3 are controlled by robot controllers RC1–RC3. Operations of the supply lines L1–L4 such as start and stop of conveying motions of conveyers thereof are controlled by a system controller SR. The robot controllers RC1–RC3 are respectively connected with the system controller SR by communication lines to enable sending/receiving of various signals necessary for dishing operations to be carried out in the manner as described later.

In the four supply lines L1–L4, lines L1, L2 and L3 are food supply lines for supplying different foods A, B and C to peripheries of the robots RB 1, RB2 and RB3, respectively. For example, the food A is fried pork, the food B is cabbage and the food C is rice. The foods A, B and C are supplied as being respectively contained in food conveying containers 10, 20 and 30 associated therewith. In this embodiment, the food conveying containers 10, 20 and 30 are placed at four areas of trays 1, 2 and 3, respectively. It is preferable that the trays 1, 2 and 3 and the food conveying containers 10, 20 and 30 are made of material resistant to heat and freeze, such as stainless steel.

The supply line L4 is a food dishing container supply line for supplying food dishing containers, such as lunch boxes and dishes, on which the foods are dished. In this embodiment, the food dishing containers are lunch boxes 50. The robots RB1, RB2 and RB3 are arranged at appropriate positions in the vicinity of the supply line L4 in this order from an upstream of the supply line L4. In this embodiment, an inner space of the lunch box 50 is divided into four spaces. The robot RB1 performs an operation of dishing the food A in the left-below space of the lunch box 50, the robot RB2 performs an operation of dishing the food B in the left-above space of the lunch box 50, and the robot RB3 performs an operation of dishing the food C in the right-below space of the lunch box 50, as shown in FIG. 1.

Each of the supply lines L1–L3 is controlled to repeat start and stop of conveying motion periodically. Specifically, the supply lines L1, L2 and L3 are controlled to temporally stop their conveying motions when the tray 1, 2 and 3 arrive at positions suitable for the robot RB1, RB2 and Rb3 to handle the food conveying container 10, 20 and 30, respectively. The robots RB1, RB2 and RB3 handle the food conveying container 10, 20 and 30, respectively, upon receipt of a tray arrival signal from the system controller SR.

Figure 3B:
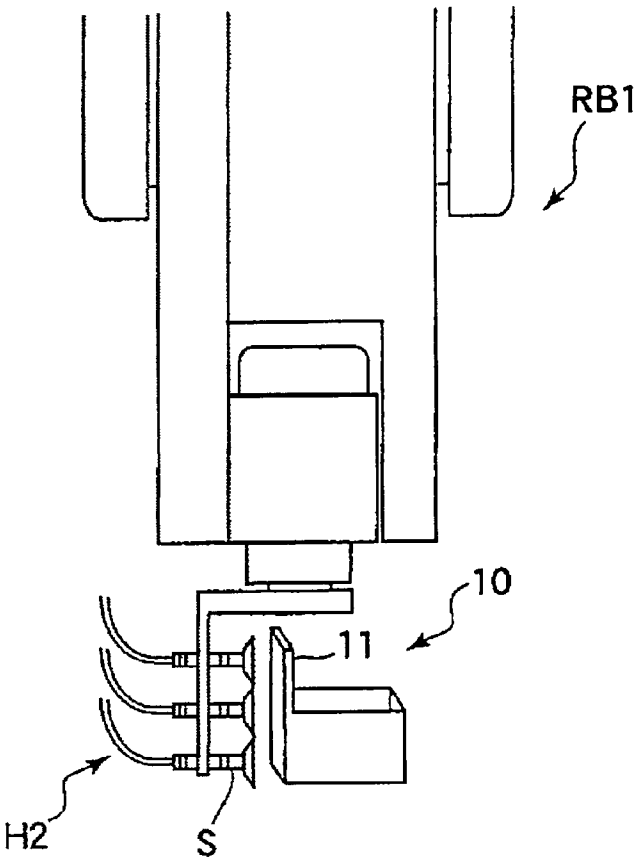
FIG. 3*b* is a schematic view showing handling of a food conveying container by sucking.
Figure 3A:
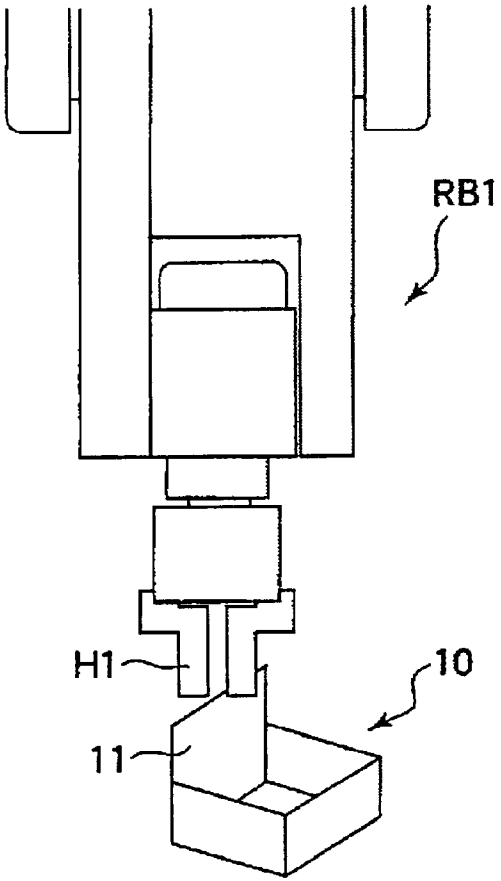
FIG. 3*a* is a schematic view showing a handling operation of a food conveying container by holding.

FIGS. 3*a* and 3*b* show examples of the handling of the food conveying container 10 by the robot RB1. FIG. 3*a* shows an example of handling of the container 10 by □holding□ in which one side of the rectangular food conveying container 10 is elongated to form a handling portion 11 to be gripped by a hand H1 of the robot RB 1. FIG. 3*b* shows an example of handling of the container 10 by □suction□ in which the handling portion 11 of the container 10 is held by suction of sucking disks provided at a hand H2 of the robot RB1. The above arrangements are adoptable in handling of the food conveying containers 20 and 30 by the robot RB1 and RB2, respectively.

The food dishing container supply line L4 for supplying lunch boxes 50 is controlled to repeat start and stop of conveying motion periodically by the system controller SR. Specifically, the supply line L4 is controlled to temporally stop its conveying motion when an empty lunch boxes 50 arrives at a predetermined position suitable for the robot RB1 to dish the food A on the lunch box 50.

A distance between the lunch boxes on the supply line L4 and the install positions of the robot RB1–Rb3 are set such that the position of the temporary stoppage of the supply line L4 when the empty lunch box 50 arrives at the predetermined position is also suitable for the robot RB2 to dish the food B on a lunch box 50 with the dished food A which is positioned ahead of the empty lunch box 50 by several ones (for example two lunch boxes ahead) and also suitable for the robot RB3 to dish the food C on a lunch box 50 with the dished foods A and B which is positioned further ahead of the lunch box 50 which is positioned in the vicinity of the robot RB 2 by several ones (for example four lunch boxes ahead).

Thus, the foods A, B and C are dished on the respective three lunch boxes 50 simultaneously in a period of one temporary stop of the supply line L4 by the robots RB1, RB2 and RB3, respectively. The period of each temporary stop of the line L4 terminates immediately after the completion of the dishing operations of the foods A, B and C on the three lunch boxes 50 by the respective robots RB1, RB2 and RB3, and the conveying motion of the supply line L4 is restarted. Thereafter, when a next empty lunch boxes 50 arrives at the predetermined position suitable for the dishing operation by the robot Rb1, the conveying motion of the supply line L4 is temporally stopped. The stoppage of the conveying motion of the supply line L4 can be controlled based on a signal from a limit switch or an optical sensor for sensing the arrival of the lunch box 50 at the predetermined position.

The robots RB1, RB2 and RB3 are operated to move the food conveying container 10, 20 and 30 held by the hands be positioned at predetermined dishing positions, respectively. Specifically, the robot RB1 is operated to move the food containing container 10 to a dishing position suitable for dishing the food A in the left-below space of the lunch box 50 which is temporally stopped at the predetermined position for the robot RB1. The robot RB2 is operated to move the food conveying container 20 to a dishing position suitable for dishing the food B in the left-above space of the lunch box 50 which is temporally stopped at the predetermined position for the robot RB2. The robot RB3 is operated to move the food conveying container 30 to a dishing position suitable for dishing the food C in the right-below space of the lunch box 50 which is temporally stopped at the predetermined position for the robot RB3.

The dishing positions are set in spaces over the respective lunch boxes 50. After moving the food conveying containers 10, 20 and 30 to the respective dishing positions, the robots RB1, RB2 and RB3 dishes the food A, B and C on the respective lunch boxes 50 in the predetermined spaces in the lunch boxes 50. The foods A, B and C are dished on the respective lunch boxes 50 by discharging the foods A, B and C contained in the food conveying container 10, 20 and 30, respectively, therefrom.

In order to securely discharging the foods out of the food conveying containers, various structures of the food conveying containers are adoptable. Examples of variations of the food conveying container are shown in FIG. 4*a*–4*d*. These examples are applicable to the discharging of the food according to the gravitation by inclining the food conveying container by the robot.

Figure 4A:
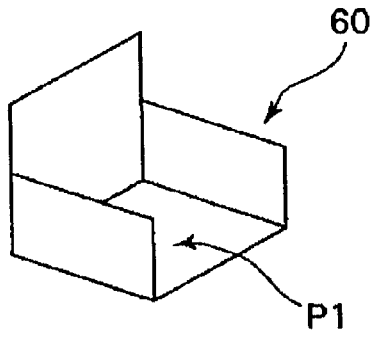
FIG. 4*a*–4*d* are schematic perspective views showing variations of the food conveying container.

A food conveying container 60 shown in FIG. 4*a* is a basic type in which one side of an opened cuboid is cut off to form a cutout P1.

The food conveying container 60 is carried by the robot to the dishing position over the lunch box 50 with its posture such that the contained food does not drop from the cutout P1, and after confirming the arrival of the lunch box 50 based on a signal from the system controller SR, the container 60 is inclined by the robot so that the contained food is discharged out of the container 60 from the cutout P1 to drop onto the lunch box 50. The empty container 60 with the food discharged is returned to the area on the tray from which the container 60 is picked up by the robot.

Figure 4B:
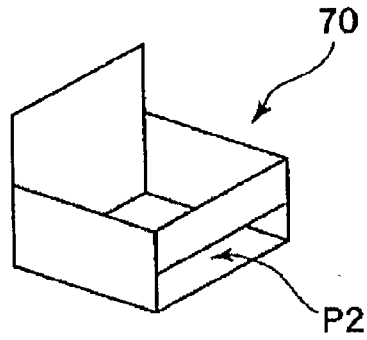
Figure 4C:
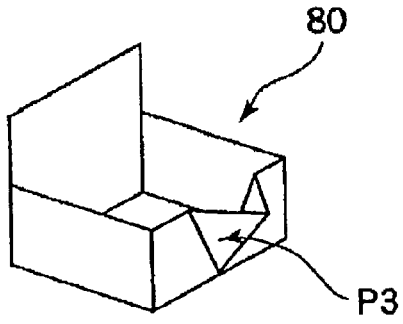
Figure 4D:
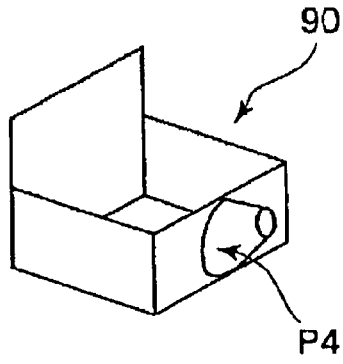

Food conveying containers 70, 80 and 90 as shown in FIGS. 4*b*–4*c* are modified types. The food conveying container 70 has an opening P2 formed in the form of a horizontal slit by partially cut off one side of the opened cuboid at the lower portion. The food conveying container 80 has a V-shaped rip P3 formed at one side of the opened cuboid. The food conveying container 90 has a spout P4 formed at one side of the opened cuboid to project therefrom like a kettle.

It is preferable to select and design the above variations of the food conveying container suitable for characteristics of the food to be contained. For example, the containers 60 and 70 are suitable for containing solid food such as fried pork, the container 90 is suitable for liquid food such as soup, and the container 80 is suitable for granular food such as boiled beans.

Figure 5:
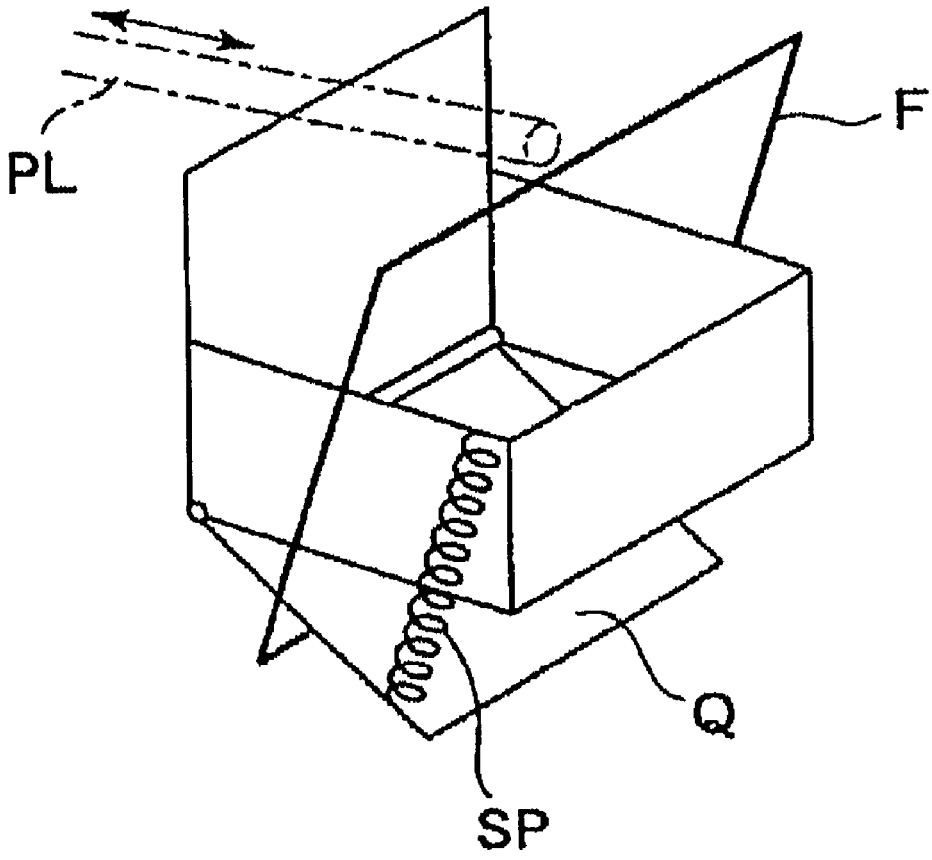
FIG. 5 is a schematic view showing another variation of the food conveying container.

A further variation of the food conveying container is shown in FIG. 5. In FIG. 5, a bottom plate Q of the opened cuboid is pivotally supported to be opened/closed according to the occasion. The bottom plate Q is urged by an appropriate elastic force of a spring SP to be closed in a normal state even with food inside. A hook F attached to the bottom plate Q is actuated to open the bottom plate Q against the elastic force of the spring SP. The bottom plate Q is opened by pushing the hook F to exceed the elastic force of the spring Sp.

A plunger PL provided in the vicinity of a hand of the robot is adoptable for pushing the hook F. The plunge PL can be actuated by an air cylinder. As a matter of course, it is unnecessary to incline the food conveying container as shown in FIG. 5 for discharging the contained food, but the inclination may be combined therewith.

Figure 6:
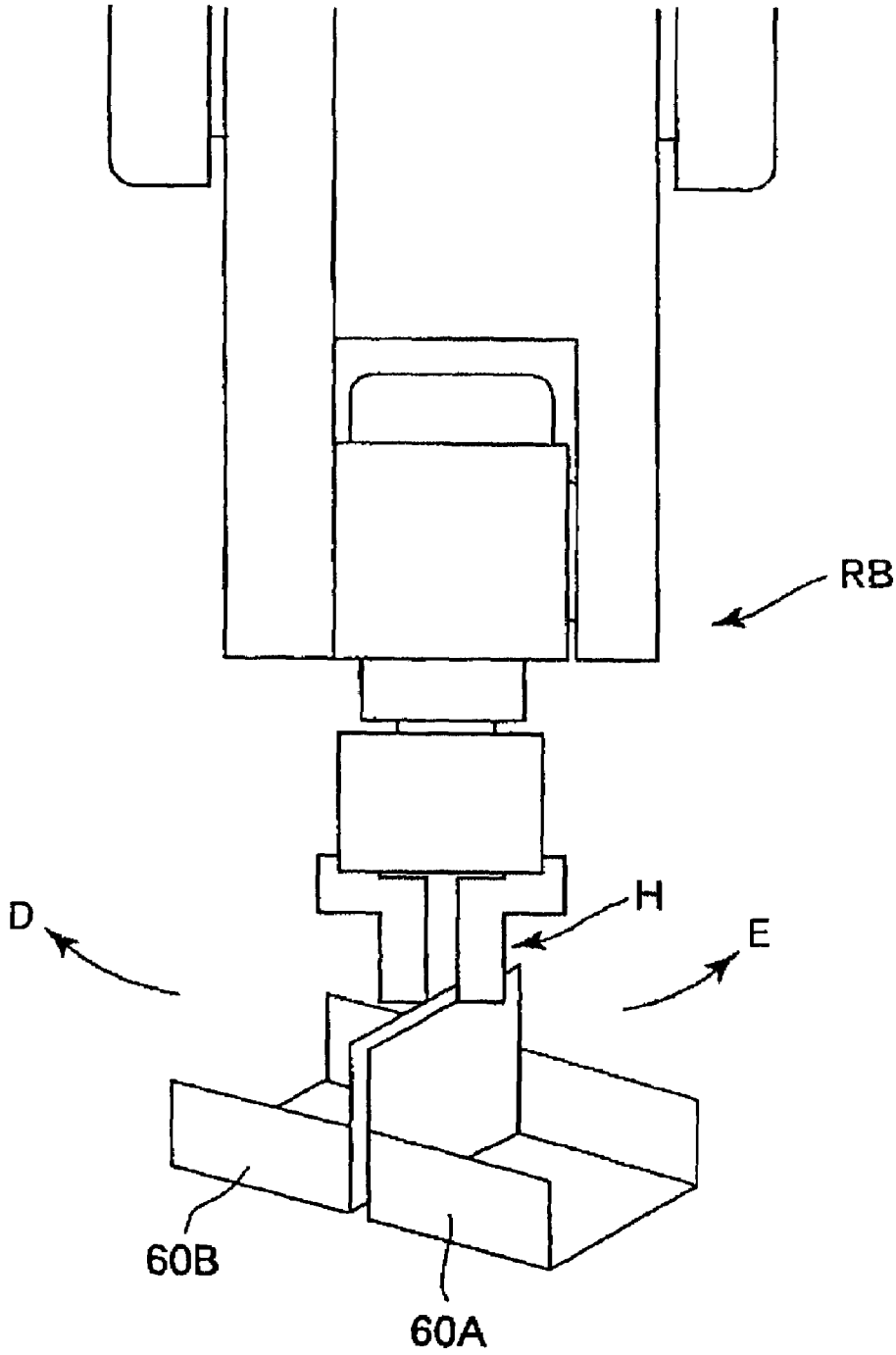
FIG. 6 is a schematic view showing handling of a plurality of food conveying container by one robot.

As occasion demands, one robot may handle a plurality of food conveying containers. Such case is shown in FIG. 6. As shown in FIG. 6, two same containers 60A and 60B with their postures symmetry are held by a hand H of the robot RB. In order to discharge the food contained in the container 60A, the robot hand H is inclined in the direction shown by an arrow D, and in order to discharge the food contained in the container 60B, the root hand H is inclined in the direction shown by an arrow E.

In order to discharge the food out of the food conveying container, an auxiliary member such as a scoop may be used. For example, for discharging adhesive food, such as mashed potatoes, which is difficult to be discharged by gravitation, the auxiliary member may be used. Such case is shown in FIG. 7*a*–7*c*.

Figure 7A:
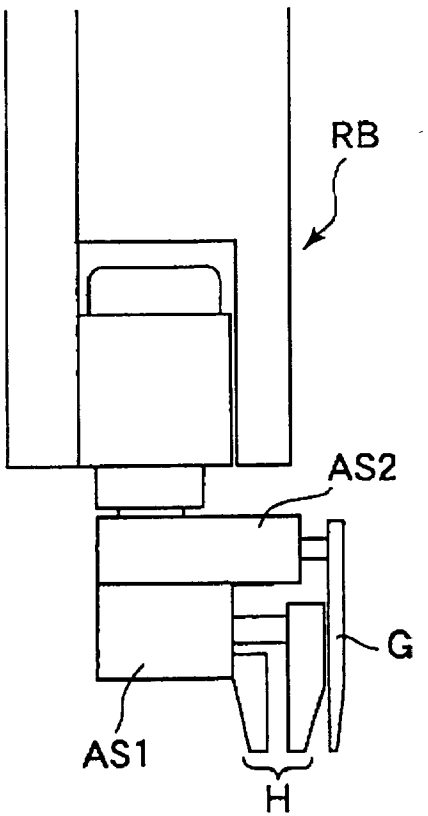

FIG. 7*a* shows a state before the robot holds the food conveying container. The robot RB is equipped with an auxiliary member G in the form of scoop driven by an air cylinder AS2 in addition to the hand H driven by an air cylinder AS1.

Figure 7B:
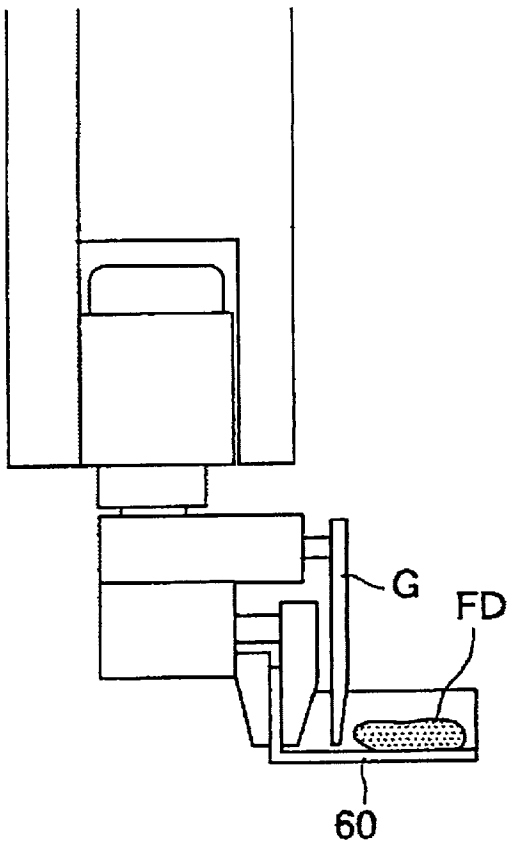
Figure 7C:
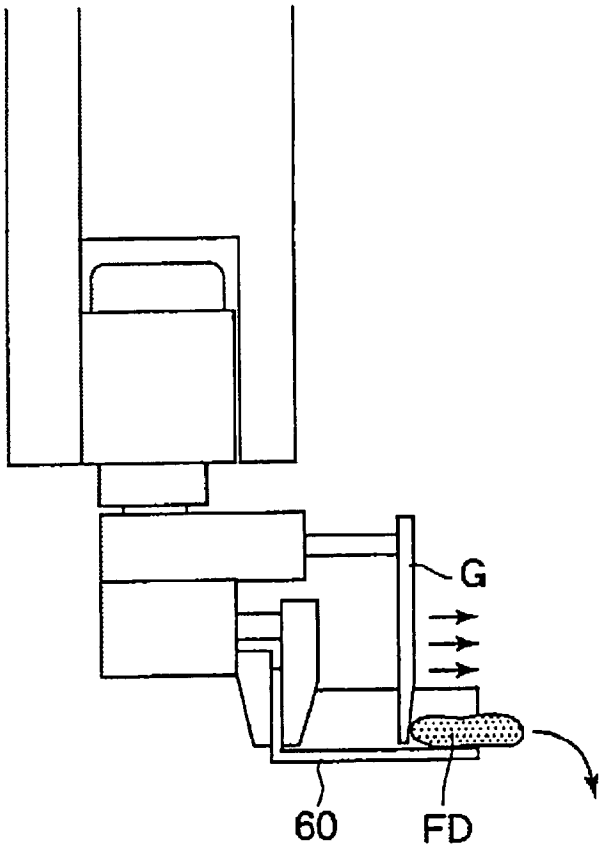

FIG. 7*b* shows a state immediately after the robot RB holds the food conveying container 60. In this state, the air cylinder AS1 is actuated but the air cylinder AS2 is not actuated to position the auxiliary member G at a rear position in the container 60, to allow adhesive food FD to stay in the container 60. Upon receipt of a command to execute dishing of food, the air cylinder AS2 is actuated to move the auxiliary member G in the right hand direction in FIG. 7*c*.

With the motion of the auxiliary member G, the adhesive food FD is forcedly discharged from the cutout P1 of the container 60 to drop into a predetermined space in the food dishing container such as the lunch box 50. The pushing motion (reciprocal motion) of the auxiliary member G may be performed a plurality of times, if necessary.

Figure 8A:
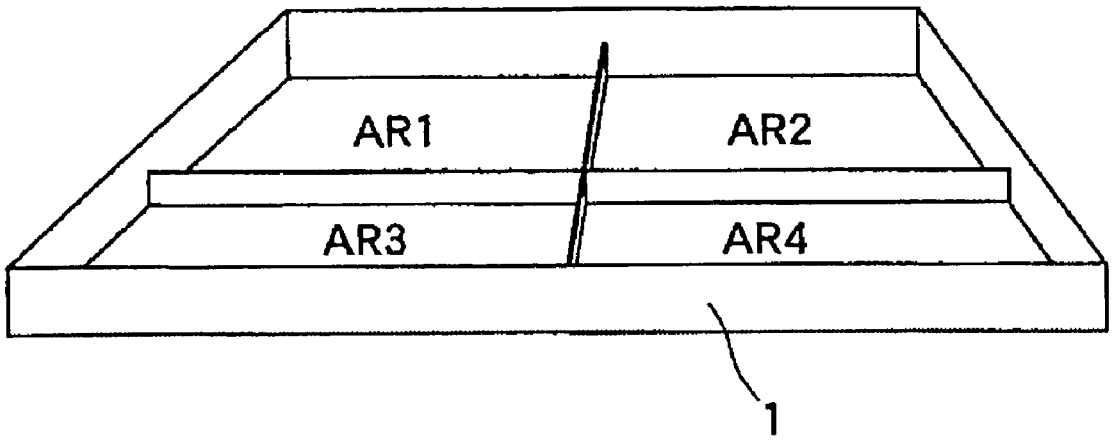
Figure 8B:
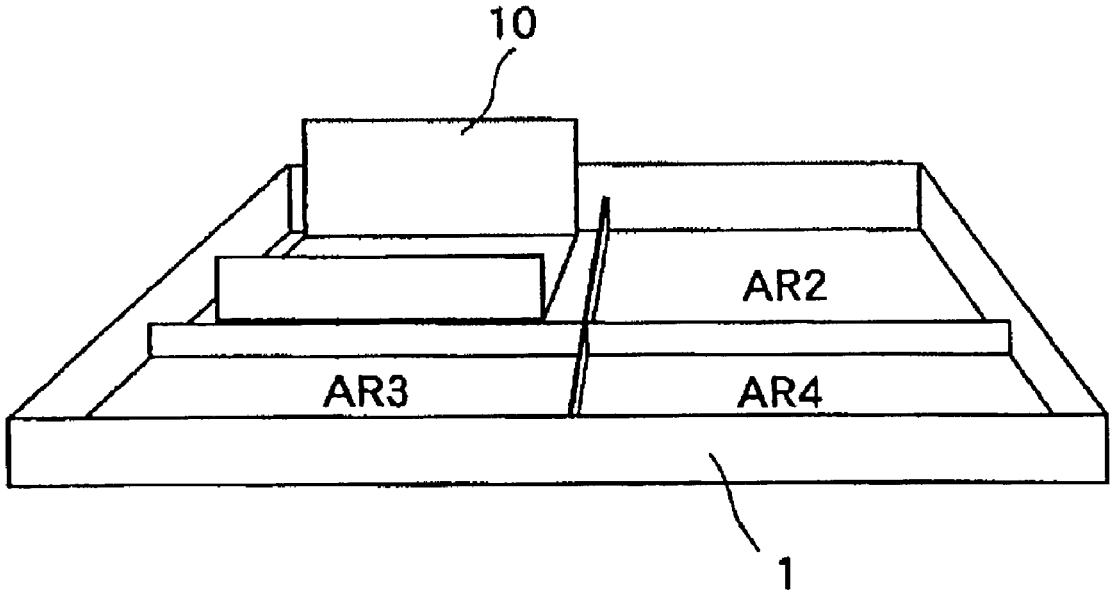

As stated, in this embodiment, four food conveying containers 10, 20 and 30 are placed on the trays 1, 2 and 3, respectively. Positions of the respective containers 10, 20 and 30 in the placement on the trays 1, 2 and 3 are designated in advance and therefore an area on each of the trays 1, 2 and 3 is divided into four areas. FIGS. 8*a* and 8*b* show examples of divided areas of the tray 1. As shown in FIG. 8*a*, the tray 1 has divided areas AR1–AR4 of the same shape and the same dimension and one food conveying container is placeable on each of the four areas AR1–AR4. FIG. 8*b* shows a state where the food conveying container 10 is place on the area AR1 of the tray 1.

Figure 9A:
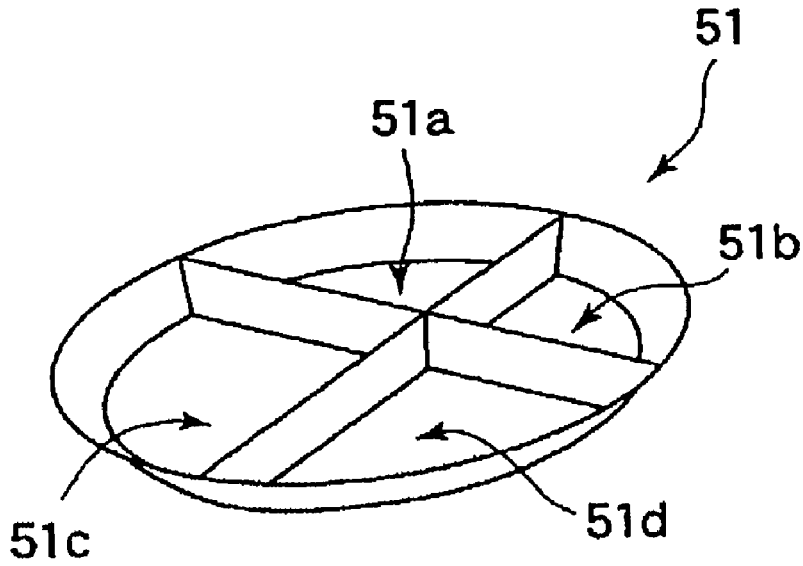
Figure 9B:
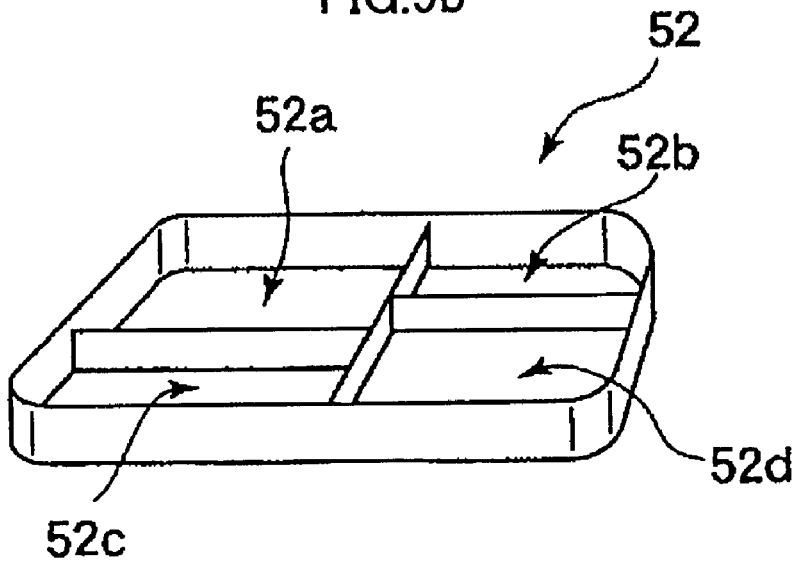

Also, as stated, in this embodiment, a space in one food dishing container (lunch box 50) is divided into four spaces. FIGS. 9*a* and 9*b* show examples of divided spaces in the lunch box. A food dishing container 51 shown in FIG. 9*a* has a substantially circular shape and has four spaces 51*a*–51*d* for dishing the foods. Each of the spaces 51*a*–51*d* has different shape and different dimension. Data representing positions (and postures, if necessary) of respective spaces 51*a*–51*d* in the container 51 are taught to respective robot controllers for the dishing operations by the respective robots.

A food dishing container 52 shown in FIG. 9*b* has a substantially rectangular shape and four areas 52*a*–52*d* for dishing the foods. As in the food dishing container 51, each of the spaces 52*a*–52*d* has different shape and different dimension. Data representing positions (and postures, if necessary) of respective spaces 52*a*–52*d* in the container 52 are taught to respective robot controllers for the dishing operations by the respective robots.

Figure 10:
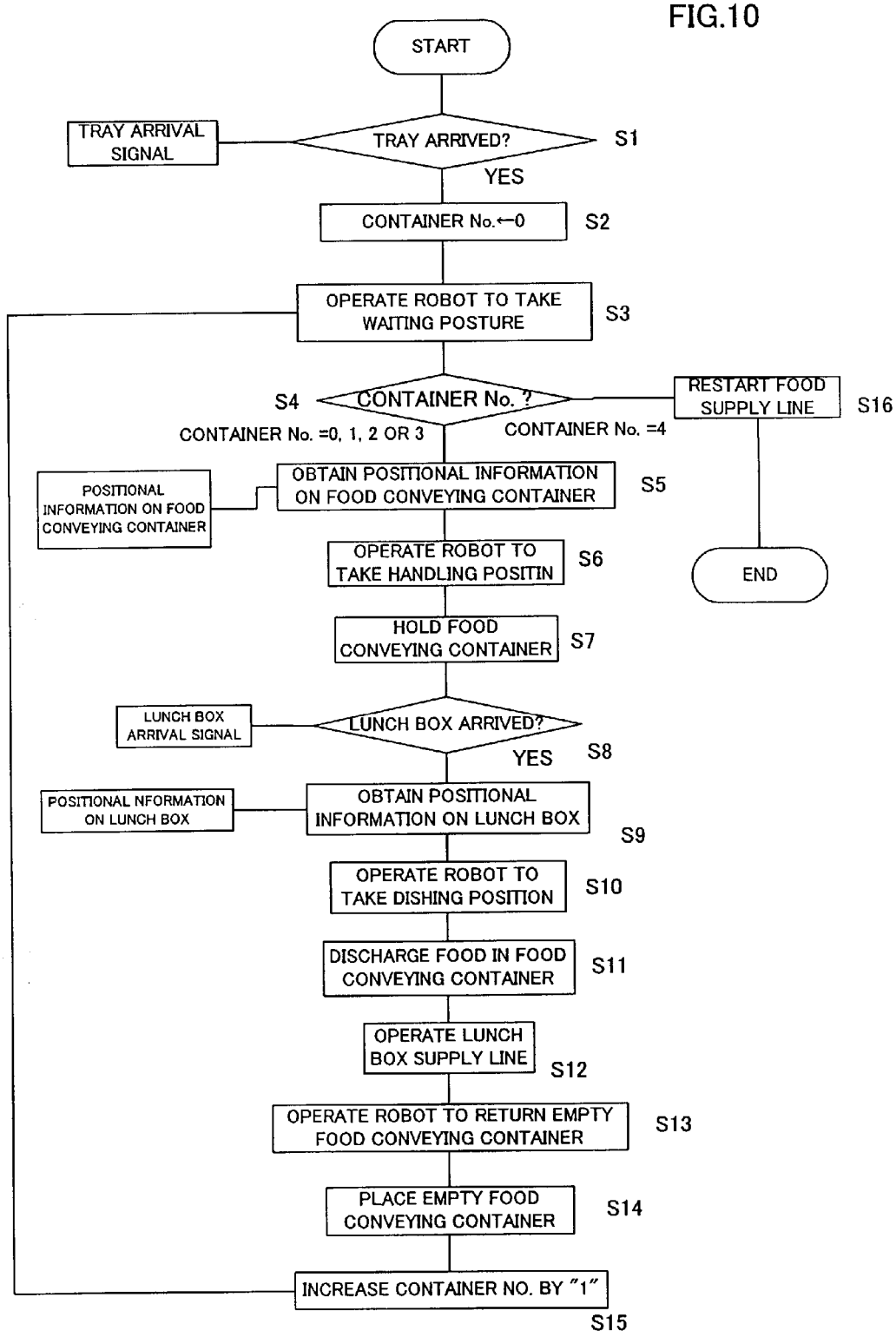
FIG. 10 is a flowchart of processing for operations of the food dishing robots according to the embodiment of the present invention.

FIG. 10 shows a summary of processing for food dishing operations to be performed by the robot controllers RC1–RC3 of the robots RB1–RB3 in the embodiment of the present invention. Substantially the same processing is performed by each of the robot controllers RC1–RC3, and therefore the robot as referred in the following description represent one of the robots RB1–RB3.

Step S1: It is determined whether or not a tray arrives and stops at the predetermined position in the vicinity of the robot, which is suitable for the handling by the robot. The determination is made based on the tray arrival signal from the system controller SR. If it is determined that a tray arrives and stops at the predetermined position, the procedure proceeds to Step S2.

Step S2: A counter for storing a container No. (counting index) indicating the number of empty food conveying containers (dishing operations of which are completed) on the tray is cleared to set to an initial value of "0". The counter No. determines a position of a food conveying container to be handled by the robot on a tray, as described later. The counter for storing the container No. is provided in a memory area in each robot controller.

Step S3: The robot is operated to take a waiting posture at a reference position for starting the dishing operation. Step S4: The container No. is read and if the container No. is one of "0", "1", "2" and "3", the procedure proceeds to Step S5. If the container No. is "4", the procedure proceeds to Step 16. The value "0" of the container No. means that the dishing operations of the foods in all of the four containers on the tray are not completed (the foods remain in all of the four containers).

The container No. of "1" means that the dishing operation of the food in the container placed at a first area (e.g. AR1 in FIG. 8) on the tray is completed (the container is empty) and the dishing operations of the foods in the containers placed in the remaining areas (e.g. AR2–AR4) are not completed (the foods are contained in the containers).

Likewise, the container No. of "2" means that dishing operations of the food in the container placed at first and second regions (e.g. AR1 and AR2 in FIG. 8) are completed and the dishing operations of the containers placed in the remaining regions (e.g. AR3 and AR4) are not completed.

The container No. of "3" means that dishing operations of the foods in the containers placed at first to third areas (e.g. AR1–AR3 in FIG. 8) are completed and a dishing operation of the food in the container placed in the remaining area (e.g. AR4) is not completed.

The container No. of "4" means that all dishing operations of the foods in the four food conveying containers on the tray are completed (all containers are empty).

Step S5: The positional information of the food conveying container to be handled by the robot are read from the memory in accordance with the container No. If the container No. is "0", the positional information of the food conveying container placed on the first area (e.g. AR1 in FIG. 8) on the tray is obtained. If the container No. is "1", the positional information of the food conveying container placed on the second area (e.g. AR2 in FIG. 8) on the tray is obtained.

Likewise, if the container No. is "2", the positional information of the food conveying container placed on the third area (e.g. AR3 in FIG. 8) on the tray is obtained. If the container No. is "3", the positional information of the food conveying container placed on the fourth area (e.g. AR4 in FIG. 8) is obtained.

The positional information of the food conveying container includes data of position (and posture, if necessary) of the food conveying container necessary for handling the food conveying container by the robot hand. In order to obtain precise positional information, a visual sensor for sensing the position of the food conveying container may be used.

Step S6: The robot is operated to take a position suitable for handling the food conveying container determined in accordance with the container No. If the container No. is "0", the robot is operated to take a position suitable for handling the food conveying container placed in the first area (e.g. the area AR1 in FIG. 8). If the container No. is "1", the robot is operated to take a position suitable for handling the food conveying container placed at the second area (e.g. the area AR2 in FIG. 8). Likewise, if the container No. is "2", the robot is operated to take a position suitable for handling the food conveying container placed in the third area (e.g. the area AR3 in FIG. 8). If the container No. is "3", the robot is operated to take a position suitable for supporting the food conveying container place in the fourth area (e.g. the area AR4 in FIG. 8).

Step S7: The food conveying container is held by the robot hand.

Step S8: It is determined whether or not the lunch box on which the food is to be dished is reached and stopped at the predetermined position for dishing. The determination is carried out based on the lunch box arrival signal from the system controller SR. The procedure proceeds to Step S9 if it is determined that the lunch box is arrived and stopped at the predetermined position.

Step S9: The positional information on the space in the lunch box is read from the memory. For example, with respect to the robot RB1, the positional information on the space (e.g. the space 51*a* in FIG. 9*a*) to which the food A is to be dished is obtained. With respect to the robot RB2, the positional information on the space to which the food B is to be dished (e.g. the area 51*b* in FIG. 9*a*) is obtained. With respect to the robot RB3, the positional information on the space to which the food C is to be dished (e.g. the area 51*c* in FIG. 9*a*) is obtained. In order to obtain precise positional information on the space in the food dishing container, a visual sensor may be used.

Step S10: Based on the information obtained in Step S9, the robot is operated to move the food conveying container held by the robot hand to a dishing position over the lunch box. The dishing position of the food conveying container is determined in accordance with the position of the space to which the food is dished (e.g. the area 51*a* for the food A in FIG. 9*a*).

Step S11: An dishing operation of discharging the food in the food conveying container is performed by inclining the food conveying container held by the robot hand. In the case where the food conveying container is of the type as shown in FIG. 5, the plunger PL is actuated to push the hook F to open the bottom plate Q. In the case where the robot hand is equipped with the auxiliary device as shown in FIG. 7, the auxiliary device G is actuated to forcedly discharge the food out of the food conveying container.

Step S12: A signal for restarting the operation of the food dishing container supply line L4 is outputted to the system controller SR. The system controller SR restarts the operation of the conveying line L4 immediately after receipt of the restarting signals from all of the robots RB1–RB3, to move the food dishing containers by the predetermined distance for the next dishing cycle.

Step S13: The robot is operated to return the empty food conveying container held by the hand to the original position on the tray.

Step S14: The robot hand is opened to place the empty food conveying container at the original position on the tray.

Step S15: The value of the container No. counter is increased by "1" and the procedure returns to Step S3.

Step S16: A signal for restarting the food supply line L1, L2 or L3 for supplying the food conveying containers is outputted to the system controller SR upon determination of the container No. of "4". The system controller SR restarts the food supply line L1, L2 or L3 immediately after receipt of the restart signal, to move the food conveying containers by the predetermined distance for the next dishing cycle.

Thus, one food dishing cycle is completed and the above described processing is repeatedly carried out in the subsequent food dishing cycle.

According to the present invention, various foods of shaped, shapeless, solid, liquid, powdered, granular, hard and solid food can be dished on the food dishing container, such as a lunch box. By adopting a method of carrying a food conveying container containing the food by a robot and discharging the food from the food conveying container, since the food is not directly held by a hand of a robot, the food is not damaged and the food which is difficult to be held by the hand such as soft food can be carried and dished.

Further, the present invention proposes structures of the food conveying container to be easily handled by a hand of a robot. In particular, since a peripheral part of the food conveying container is hold by the robot hand, the robot hand does not touch the food to be hygienic so that frequency of cleaning is reduced, and stable handling is realized.

Furthermore, the present invention proposes structures of the food conveying container for easily discharging the food contained therein. In particular, a cutout, opening or a spout is provided at a side of the food conveying container to easily perform the discharge of the food by inclining the container. An opening and closing structure of the bottom plate and pushing of the food by an auxiliary device can be adopted to securely discharge the food out of the food conveying container in accordance with a kind and a characteristic of the food to be dished.

Since supply of the foods to the handling robot can be carried out using a tray on which a plurality of food conveying containers are placed, supply and storage of an amount of foods are carries out at a time.

By adopting the food conveying container and the tray made of heat-resistant material, processing of the food by heat and warming of the food can be done at a time efficiently.

In the case where an inner space of the food dishing container such as a lunch box is divided into a plurality of spaces, a designated food can be dished to a designated space in the food dishing container.

Since the food conveying container of a standard shape can be used, it is not necessary to use a special hand.

The present invention enables mechanization and robotization of all of processes of processing, conveyance, cooking and dishing of foods to contribute automation and energy-saving in a food processing factory as well as in a food processing workshop.

What is claimed is:

1. A food dishing robot system for performing a dishing operation of a food comprising:

a robot having a hand for handling a food conveying container; and a controller for controlling said robot to hold the food conveying container containing the food by said hand, to carry the food conveying container held by the hand over a food dishing container, and to dish the food contained in the food conveying container on the food dishing container.

2. A food dishing robot system according to claim 1, wherein said hand holds a periphery of the food conveying container to be carried.

3. A food dishing robot system according to claim 1, wherein said hand simultaneously holds a plurality of food conveying containers to be carried.

4. A food dishing robot system according to claim 1, further comprising food supply means for supplying the food conveying container containing the food to said robot, and food dishing container supply means for supplying the food dishing container to said robot, wherein said food conveying container has a cutout on a side thereof, and said controller controls said robot to incline the food conveying container held by said hand such that the food contained in the food conveying container is discharged therefrom through said cutout.

5. A food dishing robot system according to claim 4, wherein said food supply means has a tray on which at least one food conveying container is placed and the food conveying container placed on the tray is supplied to said robot.

6. A food dishing robot system according to claim 4, wherein said food dishing container has a plurality of divided spaces, and said controller designates a space of said plurality of divided spaces to which the food contained in the food conveying container held by said hand is to be dished and controls said robot to dish the food to the designated space in the food dishing container.

7. A food dishing robot system according to claim 6, wherein said controller includes means for providing positional information on the food dishing container, and controls said robot to dish the food to the designated space in the food dishing container based on the provided positional information.

8. A food dishing robot system according to claim 1, further comprising food supply means for supplying the food conveying container containing the food to said robot, and food dishing container supply means for supplying the food dishing container to said robot, wherein said food conveying container has a cutout on a side thereof, and said hand has an auxiliary member in the form of scoop, and said controller controls said robot such that the food contained in the food conveying container is discharged through said cutout out of the food conveying container by means of said auxiliary member.

9. A food dishing robot system according to claim 1, further comprising food supply means for supplying the food conveying container containing the food to said robot, and food dishing container supply means for supplying the food dishing container to said robot, wherein said food conveying container has a spout on a side thereof, and said controller controls said robot to incline the food conveying container held by said hand such that the food contained in the food conveying container is discharged therefrom through said spout.

10. A food dishing robot system according to claim 1, further comprising food supply means for supplying the food conveying container containing the food to said robot, and food dishing container supply means for supplying the food dishing container to said robot, wherein said food conveying container has an opening/closing bottom portion, and said controller controls said robot to open said opening/closing bottom portion such that the food contained in the food conveying container is discharged therefrom.

11. A food dishing robot system according to claim 10, wherein said tray is made of heat-resistant material.

12. A food dishing robot system according to claim 1, wherein said food conveying container is made of heat-resistant material.

* * * * *

UNITED STATES PATENT AND TRADEMARK OFFICE

CERTIFICATE OF CORRECTION

PATENT NO. : 7,107,123 B2
APPLICATION NO. : 10/278864
DATED : September 12, 2006
INVENTOR(S) : Atsushi Watanabe et al.

It is certified that error appears in the above-identified patent and that said Letters Patent is hereby corrected as shown below:

In the drawings:
FIG. 10, change "POSITIN" to --POSITION--.

FIG. 10, change "NFORMATION" to --INFORMATION--.

Column 3, Line 41, change "RB 1" to --RB1--.

Column 4, Line 2, change "Rb3" to --RB3--.

Column 4, Line 50, change "Rb1," to --RB1,--.

Column 8, Line 47, change "An" to --A--.

Signed and Sealed this

Thirtieth Day of January, 2007

JON W. DUDAS
*Director of the United States Patent and Trademark Office*